US009994413B2

(12) United States Patent
Abe

(10) Patent No.: US 9,994,413 B2
(45) Date of Patent: Jun. 12, 2018

(54) SHEET PROCESSING DEVICE AND IMAGE FORMING APPARATUS

(71) Applicant: CANON KABUSHIKI KAISHA, Tokyo (JP)

(72) Inventor: Hideto Abe, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 248 days.

(21) Appl. No.: 14/790,129

(22) Filed: Jul. 2, 2015

(65) Prior Publication Data

US 2016/0002000 A1 Jan. 7, 2016

(30) Foreign Application Priority Data

Jul. 3, 2014 (JP) ..... 2014-137418
Jun. 24, 2015 (JP) ..... 2015-126586

(51) Int. Cl.
*B31F 5/02* (2006.01)
*B65H 37/04* (2006.01)
(Continued)

(52) U.S. Cl.
CPC ..... *B65H 37/04* (2013.01); *B31F 1/07* (2013.01); *B31F 5/02* (2013.01); *B42F 3/00* (2013.01);
(Continued)

(58) Field of Classification Search
CPC ..... B31F 1/07; B31F 5/02; B31F 2201/0712; B42F 3/00; B42F 3/003; B65H 2301/51616; G03G 2215/00852
(Continued)

(56) References Cited

U.S. PATENT DOCUMENTS 3,554,122 A * 1/1971 Priesmeyer ..... B44B 5/0085 101/297
8,342,497 B2 1/2013 Abe
(Continued)

FOREIGN PATENT DOCUMENTS

JP 2010-189101 A 9/2010
JP 2010189101 A * 9/2010
JP 2011201698 A * 10/2011

OTHER PUBLICATIONS

Machine translation of JP 2010-189101 A, https://www4.j-platpat.inpit.go.jp/cgi-bin/tran_web_cgi_ejje?u=http://www4.j-platpat.inpit.go.jp/eng/translation/201705030144056922441637132 77-8982187CF280C74CBA945E7631348E2E2D695.*
(Continued)

*Primary Examiner* — Leslie A Nicholson, III
(74) *Attorney, Agent, or Firm* — Fitzpatrick, Cella, Harper & Scinto

(57) ABSTRACT

According to an aspect of the present invention, there is provided a sheet processing device including a first teeth portion, a second teeth portion that clamps and binds a sheet bundle with the first teeth portion, a first support portion supporting the first teeth portion, a shaft, and a second support portion supporting the second teeth portion. The second support portion includes first and second arm members integrally supported to be capable of swinging around the shaft between a binding position in which the second teeth portion clamps and binds the sheet bundle with the first teeth portion and a standby position in which the second teeth portion is apart from the first teeth portion. The second arm member is provided over the first arm member so as to cover a part of the first arm member.

19 Claims, 13 Drawing Sheets

(51) Int. Cl.
*G03G 15/00* (2006.01)
*B42F 3/00* (2006.01)
*B31F 1/07* (2006.01)

(52) U.S. Cl.
CPC ..... *B42F 3/003* (2013.01); *G03G 15/6538* (2013.01); *G03G 15/6544* (2013.01); *B31F 2201/0712* (2013.01); *B65H 2301/5126* (2013.01); *B65H 2801/27* (2013.01); *G03G 2215/00822* (2013.01)

(58) Field of Classification Search
USPC ..... 270/58.07, 58.08
See application file for complete search history.

(56) References Cited

U.S. PATENT DOCUMENTS

2012/0090441 A1 4/2012 Abe
2013/0190156 A1* 7/2013 Matsukawa ..... B42F 3/003 493/351
2014/0003852 A1 1/2014 Abe et al.
2014/0138896 A1* 5/2014 Yoshida ..... B42B 5/00 270/58.11
2014/0161565 A1 6/2014 Obuchi et al.
2014/0339754 A1* 11/2014 Abe ..... B65H 39/00 270/1.01
2015/0003939 A1 1/2015 Abe
2015/0030414 A1* 1/2015 Takahashi ..... B42C 13/00 412/33
2015/0239587 A1 8/2015 Abe

OTHER PUBLICATIONS

U.S. Appl. No. 14/834,990, filed Aug. 25, 2015.
U.S. Appl. No. 14/729,587, filed Jun. 3, 2015.

* cited by examiner

SHEET PROCESSING DEVICE AND IMAGE FORMING APPARATUS

BACKGROUND OF THE INVENTION

Field of the Invention

This disclosure relates to a sheet processing device and an image forming apparatus, and, specifically, relates to binding sheets without using staples.

Description of the Related Art

In the related art, an image forming apparatus such as a copier, a laser beam printer, a facsimile, and a complex machine thereof, includes a sheet processing device that performs processing of binding sheets on which images are formed. In such an image forming apparatus, if a sheet bundle is bound by the sheet processing device, in general, the sheet bundle is bound using metal staples. Then, since staple processing using such staples can reliably bind a plurality of output papers in a position which is designated by a user, staple processing is employed in many sheet processing devices.

However, when the sheets in which a staple processing is performed are inserted into a shredder, it requires work to remove the staples and is troublesome. In addition, if the sheet bundle which is bound with the staples is recycled, it is necessary to recover the sheets by removing the staples and separating the sheets and the staples, which is troublesome.

Thus, a sheet processing device has been proposed in which recycling is emphasized and the sheets are bound without using staples. For example, such a sheet processing device has been proposed in JP-A-2010-189101 in which a binding process is performed in a sheet bundle by a binding portion including convex upper teeth and concave lower teeth.

In the sheet processing device, after the sheets are bound and aligned, the lower teeth and the upper teeth of the binding unit are engaged with each other, uneven portions are formed in a part of the sheet bundle in a thickness direction, fibers of overlapped sheets are tangled with each other, and then the sheet bundle is bound. Moreover, in the sheet processing device, the fibrous sheets are bound without using staples. It is noted that, hereinafter, a binding method for binding the fibrous sheet bundle without using such staples is referred to as stapleless binding.

In the sheet processing device in which stapleless binding is performed, the lower teeth are mounted on one end portion of a fixed lower arm and the upper teeth are mounted on one end portion of an upper arm that is supported by the lower arm to be swingable in a vertical direction. Then, when binding the sheet bundle, the lower teeth and the upper teeth are engaged with each other by swinging the upper arm, thereby binding the sheet bundle.

However, when performing stapleless binding, in order to reliably perform stapleless binding, it is necessary to apply a great load to the lower teeth and the upper teeth in the sheet processing device. The load increases if a binding area of the teeth is increased which increases a binding force. Furthermore, as in a copier, the fibers of the sheet dry in a process of printing by applying heat on the sheet, so that fibers are unlikely to be tangled with each other. Thus, in order to reliably perform stapleless binding even if the fibers of the sheet are dry, it is necessary to apply a great load to the lower teeth and the upper teeth.

On the other hand, if such a great load is applied, large stress is applied to the arms on which the lower teeth and the upper teeth are mounted. In order to withstand such large stress, in general, the arm is created by bending a metal plate in a U-shape. Load-bearing is high as the U-shape is great and load-bearing can be high as a thickness of the metal plate forming the U shape is thick.

In recent years, since a demand for downsizing the sheet processing device and the image forming apparatus is increased, a small sized arm is desired. Thus, in order to reduce a size of an external shape of the arm to be as small as possible and to increase load-bearing, it is necessary to increase the thickness of the metal plate, but if the thickness of the metal plate is increased in a state where the size of the external shape is reduced, it is difficult to form the arm by press working.

For example, a through-hole through which a shaft is inserted for supporting the upper arm to be swingable with respect to the lower arm in the vertical direction is formed in the upper arm. However, in a case where the through-hole is formed in the upper arm, if a distance between a top surface of the U-shaped arm and the through-hole is not twice the thickness of the plate, the through-hole is deformed during a bending process after hole making. It is noted that, if the distance cannot be ensured, it is necessary to form the through-hole by a secondary process after bending is performed and manufacturing cost is greatly increased.

That is, in order to hold load-bearing in a state where the size of the external shape of the arm is extremely reduced to downsize the apparatus, the thickness of the metal plate may be increased, but if the thickness is increased, since the secondary process of the hole is necessary, there is a limit to reduce the size of the arm.

SUMMARY OF THE INVENTION

According to an aspect of this disclosure, there is provided a sheet processing device including a first teeth portion, a second teeth portion that clamps and binds a sheet bundle with the first teeth portion, a first support portion supporting the first teeth portion, a shaft, and a second support portion supporting the second teeth portion. The second support portion includes first and second arm members integrally supported to be capable of swinging around the shaft between a binding position in which the second teeth portion clamps and binds the sheet bundle with the first teeth portion and a standby position in which the second teeth portion is apart from the first teeth portion. The second arm member is provided over the first arm member so as to cover a part of the first arm member.

Further features of the present invention will become apparent from the following description of exemplary embodiments with reference to the attached drawings.

DESCRIPTION OF THE EMBODIMENTS

Figure 1:
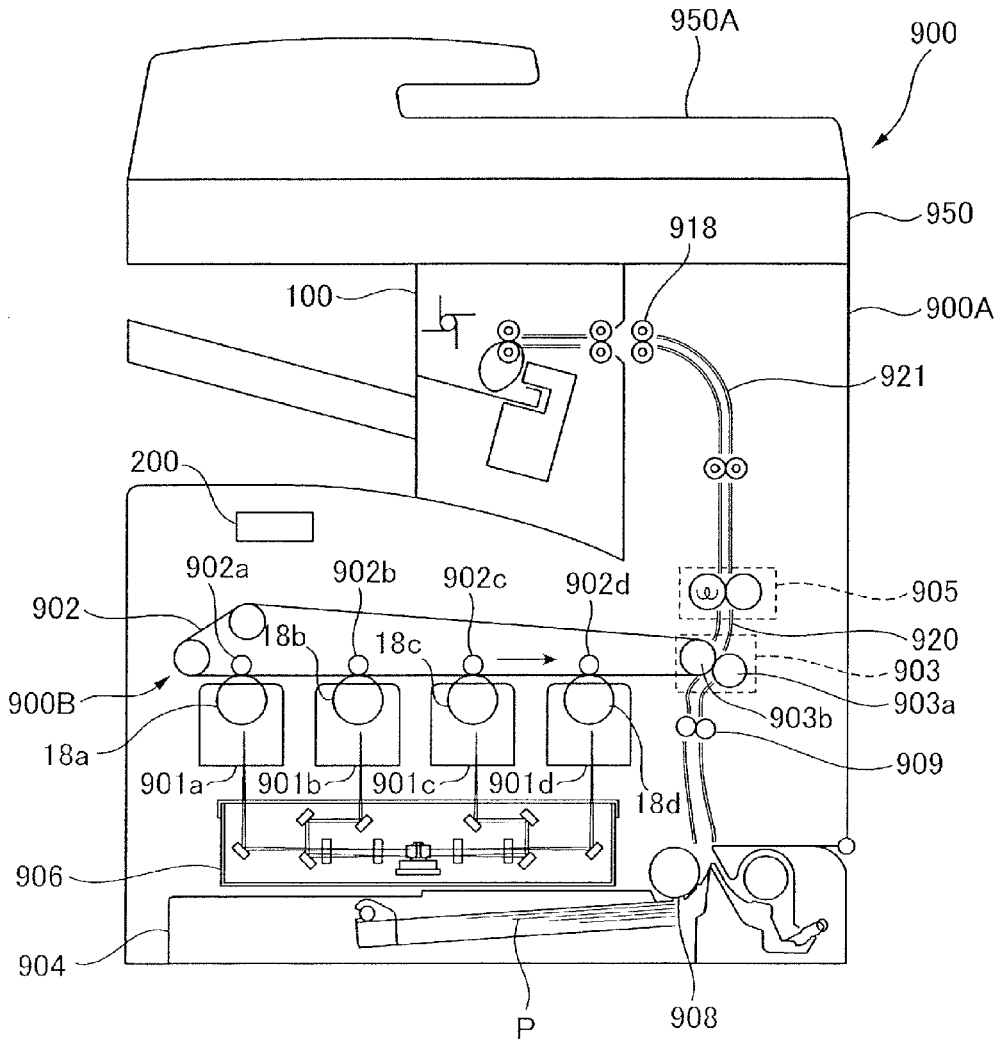
FIG. 1 is an overall schematic diagram illustrating a configuration of an image forming apparatus including a finisher according to an embodiment of this disclosure.

Hereinafter, an embodiment of this disclosure will be described in detail with reference to the drawings. FIG. 1 is a diagram illustrating a configuration of an image forming apparatus including a sheet processing device according to the embodiment of this disclosure.

As illustrated in FIG. 1, an image forming apparatus 900 includes an image forming apparatus body 900A (hereinafter, referred to as an apparatus body) having an image forming portion 900B that forms an image on a sheet, an image reading apparatus 950 that is provided in an upper portion of the apparatus body 900A and includes an original conveying unit 950A, and a finisher 100 that is a sheet processing device disposed between the upper surface of the apparatus body 900A and the image reading apparatus 950.

Here, the image forming portion 900B includes photoconductive drums 18*a* to 18*d* that form toner images of four colors of yellow, magenta, cyan, and black, and an exposing unit 906 that forms an electrostatic latent image on the photoconductive drum by applying a laser beam based on image information. It is noted that, the photoconductive drums 18*a* to 18*d* are driven by a motor (not illustrated) and a primary charger, a developer, and a transfer charger which are not illustrated respectively are disposed in a periphery thereof. The photoconductive drums 18*a* to 18*d* are unitized as process cartridges 901*a* to 901*d*.

Furthermore, the image forming portion 900B includes an intermediate transfer belt 902 that is driven to rotate in an arrow direction, a secondary transfer unit 903 that sequentially transfers a full color image formed in the intermediate transfer belt 902 to a sheet P, and the like. Then, respective color toner images on the photoconductive drums are sequentially transferred to the intermediate transfer belt 902 in a superimposed manner by applying a transfer bias to the intermediate transfer belt 902 by transfer chargers 902*a* to 902*d*. Thus, the full color image is formed on the intermediate transfer belt.

A secondary transfer unit 903 is configured of a secondary transfer counter roller 903*b* that supports the intermediate transfer belt 902 and a secondary transfer roller 903*a* that abuts the secondary transfer counter roller 903*b* through the intermediate transfer belt 902. In addition, a sheet feeding cassette 904 is disposed in a lower portion of the image forming portion 900B and the sheet P stacked on the sheet feeding cassette 904 is fed by a pickup roller 908. Furthermore, a registration roller 909 is provided on a downstream side of the pickup roller 908 in a direction of conveyance. The apparatus body 900A is provided with a CPU circuit portion 200 that is a control portion.

Next, an image forming operation of the image forming apparatus 900 having such a configuration is described. When the image forming operation is started, first, the laser beam is applied through the exposing unit 906 based on image information from a personal computer (not illustrated) and the like, and surfaces of the photoconductive drums 18*a* to 18*d* which are constantly charged at a predetermined polarity and potential are sequentially exposed. Thus, electrostatic latent images are formed on the photoconductive drums 18*a* to 18*d*. Thereafter, the electrostatic latent images are developed by a toner and are visualized.

For example, first, the laser beam is applied to the photoconductive drum 18*a* through a polygon mirror of the exposing unit 906 and the like by an image signal of a yellow component color of the document. The electrostatic latent image of yellow is formed on the photoconductive drum 18*a*. Then, the electrostatic latent image of yellow is developed by a yellow toner of the developer and is visualized as a yellow toner image. Thereafter, the toner image reaches the primary transfer unit in which the photoconductive drum 18*a* and the intermediate transfer belt 902 abut in association with the rotation of the photoconductive drum 18*a*. Here, as described above, if the toner image reaches the primary transfer unit, the yellow toner image on the photoconductive drum 18*a* is transferred to the intermediate transfer belt 902 by a primary transfer bias applied to a transfer charger 902*a* (primary transfer).

Next, a portion carrying the yellow toner image of the intermediate transfer belt 902 is moved and a magenta toner image formed on the photoconductive drum 18*b* by this time in a similar manner described above is transferred on the yellow toner image carried by the intermediate transfer belt 902. Similarly, as the intermediate transfer belt 902 moves, a cyan toner image and a black toner image are respectively transferred to and overlapped the yellow toner image and the magenta toner image in the primary transfer unit. Thus, the full color toner image is formed on the intermediate transfer belt 902.

Furthermore, the sheets P stacked on the sheet feeding cassette 904 are delivered one by one by the pickup roller 908 in parallel with the toner image forming operation. Then, the sheet P reaches the registration roller 909, is timed by the registration roller 909, and then is conveyed to the secondary transfer unit 903. Thereafter, in the secondary transfer unit 903, four color toner images on the intermediate transfer belt 902 are collectively transmitted onto the sheet P by a secondary transfer bias applied to the secondary transfer roller 903*a* (secondary transfer).

Next, the sheet P to which the toner image is transferred is guided by a conveyance guide 920 from the secondary transfer unit 903 and is transported to a fixing portion 905. The toner image is fixed to the sheet P by receiving heat and pressure when passing the fixing portion 905. Thereafter, the sheet P to which such a toner image is fixed passes through a discharge passage 921 provided on a downstream side of the fixing portion 905, is discharged by a pair of discharging rollers 918, and is conveyed to the finisher 100.

Figure 2A:
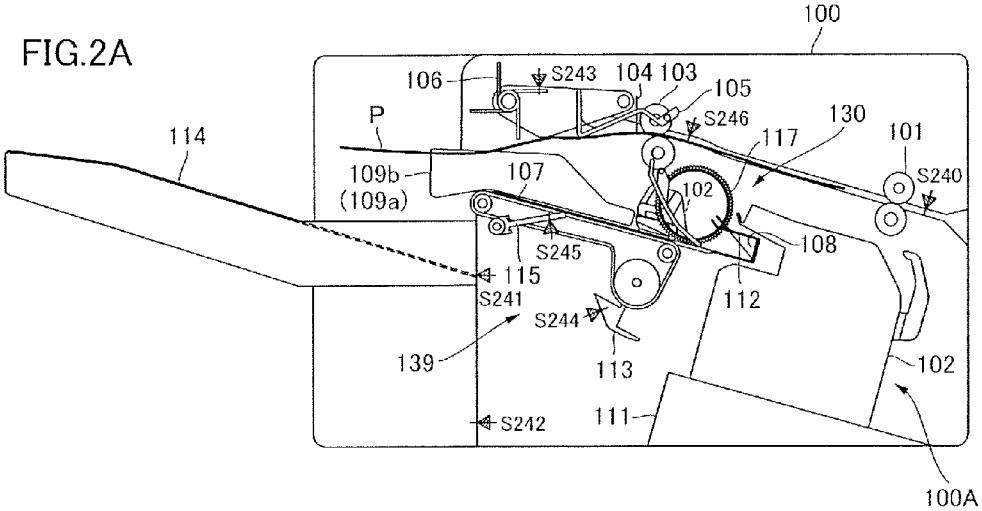
FIG. 2A is a side view illustrating the finisher in a state where a take-in paddle is positioned in a standby position.

The finisher 100 sequentially captures the sheets discharged from the apparatus body 900A, aligns a plurality of captured sheets, and performs bundling of the sheets in one bundle. If necessary, there is a binding process for binding an upstream end (hereinafter, referred to as trailing end) in a sheet discharging direction of the sheet bundle that is bundled. Then, as illustrated in FIG. 2A, the finisher 100 includes a processing portion 139 that performs the binding process and discharges the sheet to a stacking tray 114. It is noted that, the processing portion 139 includes an intermediate processing tray 107 that stacks the sheets to which the binding process is performed and a binding unit 100A that performs binding of the sheets stacked on the intermediate processing tray 107.

Furthermore, the intermediate processing tray 107 is provided with front and back aligning panels 109*a* and 109*b* that regulate (align) both side end positions of the sheet transported to the intermediate processing tray 107 in a width direction (depth direction). It is noted that, the front and back aligning panels 109*a* and 109*b* that align the side end positions of the sheet stacked on the intermediate processing tray 107 in the width direction are driven by an alignment motor M253 illustrated in FIG. 7 described below and are moved in the width direction.

Furthermore, the front and back aligning panels 109*a* and 109*b* are usually moved to a receiving position in which the sheet is received by the alignment motor M253 driven by a detection signal of an alignment home position (hereinafter, referred to HP) sensor (not illustrated). Then, when regulating both of the side end positions of the sheet stacked on the intermediate processing tray 107, the alignment motor M253 is driven, the front and back aligning panels 109*a* and 109*b* are moved along the width direction, and abut both side ends of the sheet stacked on the intermediate processing tray 107.

Furthermore, a take-in paddle 106 is disposed on a downstream side above the intermediate processing tray 107 in the direction of conveyance. Here, the take-in paddle 106 is positioned in a standby position in which the take-in paddle 106 is waiting at an upper portion not interfering with a discharging sheet by driving a paddle elevating motor M252 based on detection information of a paddle HP sensor S243 illustrated in FIG. 7 described below before the sheet is conveyed into the processing portion 139.

Furthermore, if the sheet is discharged to the intermediate processing tray 107, the take-in paddle 106 is moved downward by reverse driving of the paddle elevating motor M252 and is rotated in a counterclockwise direction by a paddle motor (not illustrated) at appropriate timing. The sheet is taken-in by the rotation and a trailing end of the sheet abuts a trailing end stopper 108. Here, in the embodiment, an aligning unit 130 aligning the sheets stacked on the intermediate processing tray 107 is configured of the take-in paddle 106, the trailing end stopper 108, and the front and back aligning panels 109*a* and 109*b*. It is noted that, for example, if an inclination of the intermediate processing tray 107 is large, the sheet can abut the trailing end stopper 108 without using the take-in paddle 106 or a knurled belt 117 described below.

Figure 2B:
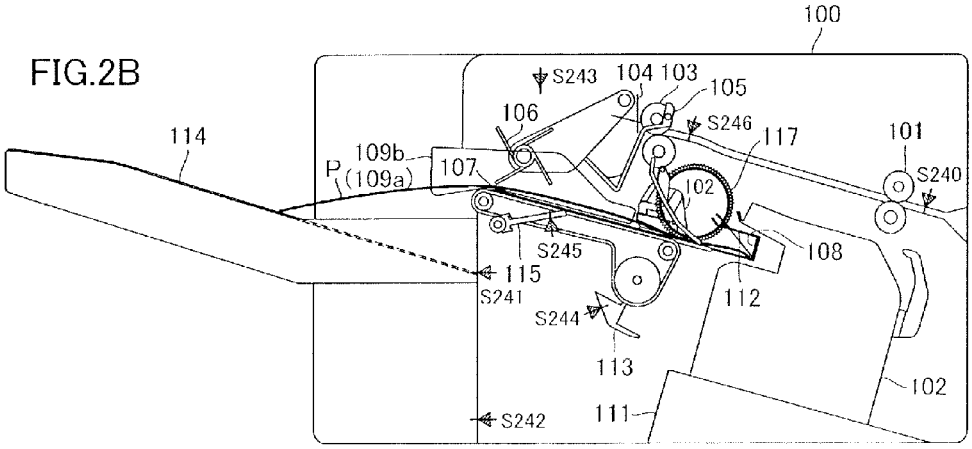
FIG. 2B is a side view illustrating the finisher in a state where the take-in paddle is positioned in a lowered position.

It is noted that, as illustrated in FIGS. 2A and 2B, the processing portion 139 has a trailing end assist 112. The trailing end assist 112 is moved in parallel with a stacking surface of the intermediate processing tray 107 by an assist motor M254 that is driven based on a detection signal of an assist HP sensor S244 illustrated in FIG. 7 described below. Then, as described below, the trailing end assist 112 discharges a sheet bundle to the stacking tray 114 after a binding process is performed on the sheet bundle.

Furthermore, the finisher 100 includes a pair of inlet rollers 101 to capture the sheet into the apparatus and a discharging roller pair 103. The sheet P discharged from the apparatus body 900A is transferred to the pair of inlet rollers 101. It is noted that, at this time, transfer timing of the sheet is also detected simultaneously by an inlet port sensor S240. Then, the sheet P transferred to the pair of inlet rollers 101 is discharged sequentially to the intermediate processing tray 107 by the discharging roller pair 103 and then abuts the trailing end stopper 108 by the take-in paddle 106 or the knurled belt 117. Thus, alignment of the sheet in the direction of sheet conveyance is performed and the sheet bundle in which an aligning process is performed is formed.

It is noted that, the processing portion 139 has a trailing end dropper member 105 and as illustrated in FIG. 2A, the trailing end dropper member 105 is pressed up by the sheet P passing through the discharging roller pair 103. Then, if the sheet P passes through the discharge rollers 103, as illustrated in FIG. 2B, the trailing end dropper member 105 presses the trailing end of the sheet P down by being dropped by its own weight.

The processing portion 139 has a neutralization needle 104 that neutralizes the charged sheet and a batch holder 115. The batch holder 115 is rotated by a batch holding motor M255 illustrated in FIG. 7 described below thereby pressing the sheet bundle stacked on the stacking tray 114. Furthermore, the finisher 100 has a tray lower limit sensor S242, a batch holder HP sensor S245, and a tray HP sensor S241. If the sheet bundle shields the tray HP sensor S241 from light, the stacking tray 114 is lowered by a tray elevating motor M251 illustrated in FIG. 7 until the tray HP sensor S241 is in a transmitting state and a paper surface position is determined.

Figure 3A:
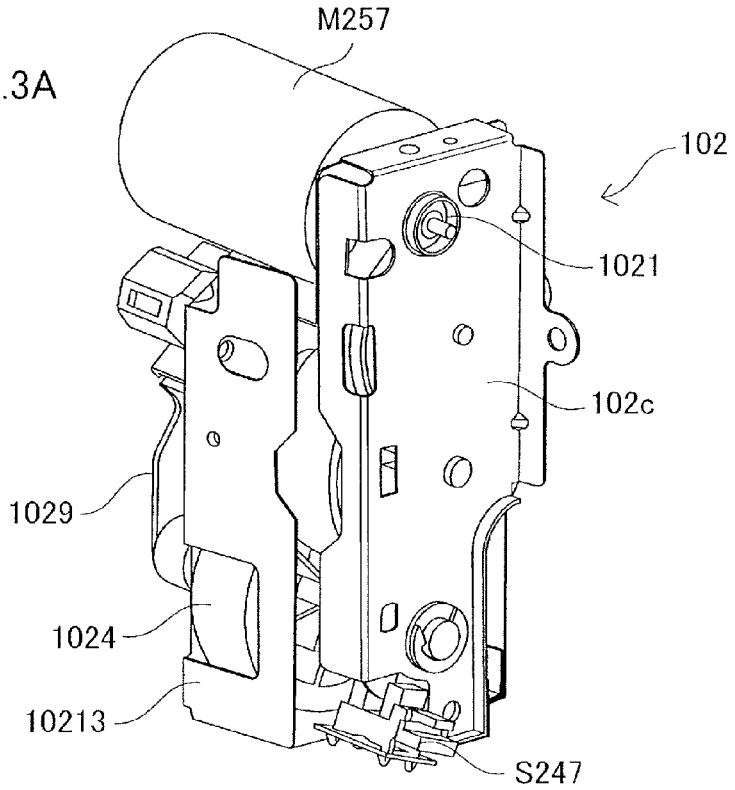
FIG. 3A is a perspective view illustrating a stapleless binding unit provided in the finisher.

Furthermore, the binding portion 100A includes a stapleless binding unit 102. Here, as illustrated in FIG. 3A, the stapleless binding unit 102 includes a stapleless binding motor M257 and a gear 1021 that is rotated by the stapleless binding motor M257. Furthermore, as illustrated in FIG. 3B that is a state where a cover 102*c* is removed from FIG. 3A, the stapleless binding unit 102 includes stage gears 1022 and 1023 that are rotated by the gear 1021.

Furthermore, the stapleless binding unit 102 includes a gear 1024 that is rotated by the stage gears 1022 and 1023. Furthermore, the stapleless binding unit 102 includes a lower arm 10212 illustrated in FIGS. 4A and 4B, which is fixed to a frame 10213 and an upper arm 1029 that is provided in the lower arm 10212 to be swingable around a shaft 10211, and is biased on the lower arm side by a biasing member (not illustrated).

Here, the gear 1024 is mounted on a rotation shaft 1026 to be relatively unrotatable. The rotation shaft 1026 is rotatably supported by the lower arm 10212 and the frame 10213. Then, a cam 1027 is fixed to the rotation shaft 1026 and the cam 1027 is provided between the upper arm 1029 and the lower arm 10212. Thus, if the stapleless binding motor M257 is rotated, the rotation of the stapleless binding motor M257 is transmitted to the rotation shaft 1026 through the gear 1021, the stage gears 1022 and 1023, and the gear 1024, and then the cam 1027 rotates.

Figure 3B:
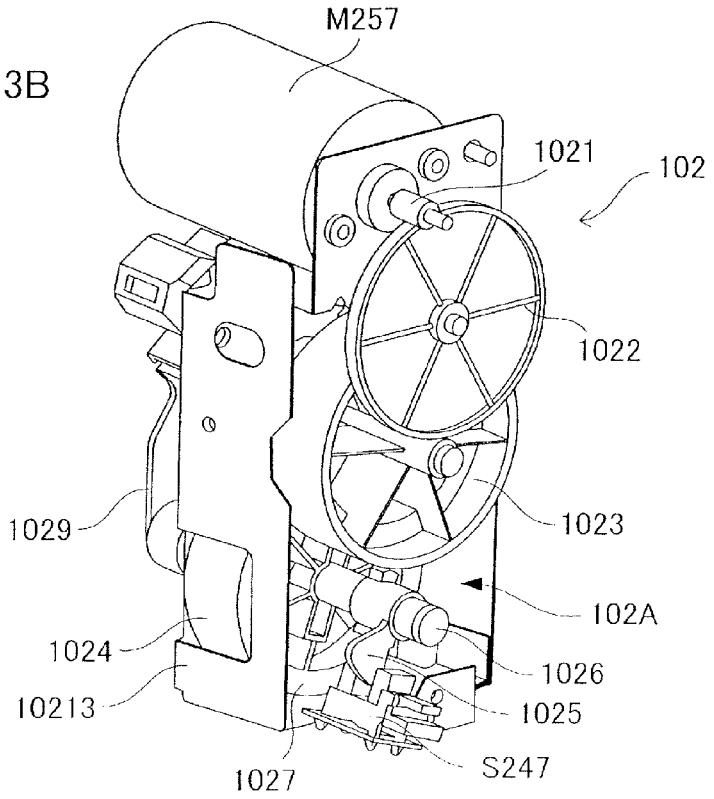
FIG. 3B is a perspective view illustrating the stapleless binding unit in a state where a cover is removed.

As described above, in the embodiment, a moving unit 102A illustrated in FIG. 3B, which swings the upper arm 1029, is configured of the stapleless binding motor M257, the cam 1027, the gear 1021, the stage gears 1022 and 1023, and the gear 1024. Then, the moving unit 102A swings the upper arm 1029 to the binding position and to the release position. In a state where the upper arm 1029 is positioned in the binding position, as illustrated in FIGS. 4B and 5, upper teeth 10210 and lower teeth 10214 engage and bind a plurality of sheets. Furthermore, in a state where the upper arm 1029 is positioned in the release position (standby position) in which the upper teeth 10210 are moved away from the lower teeth 10214, as illustrated in FIG. 4A, the upper teeth 10210 and the lower teeth 10214 are moved away and engagement with the sheets is released.

Figure 4A:
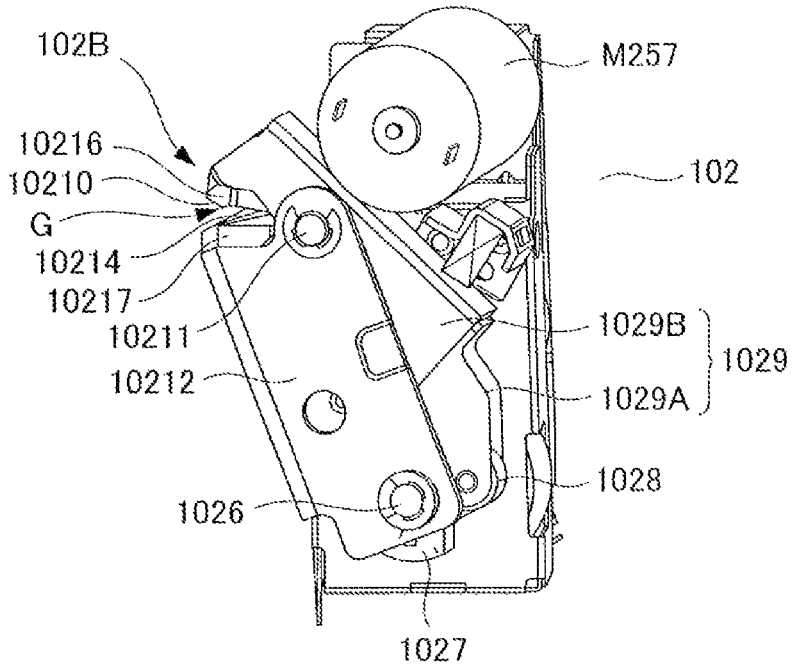
FIG. 4A is a side view illustrating the stapleless binding unit in a state where an upper arm is positioned in a release position.
Figure 4B:
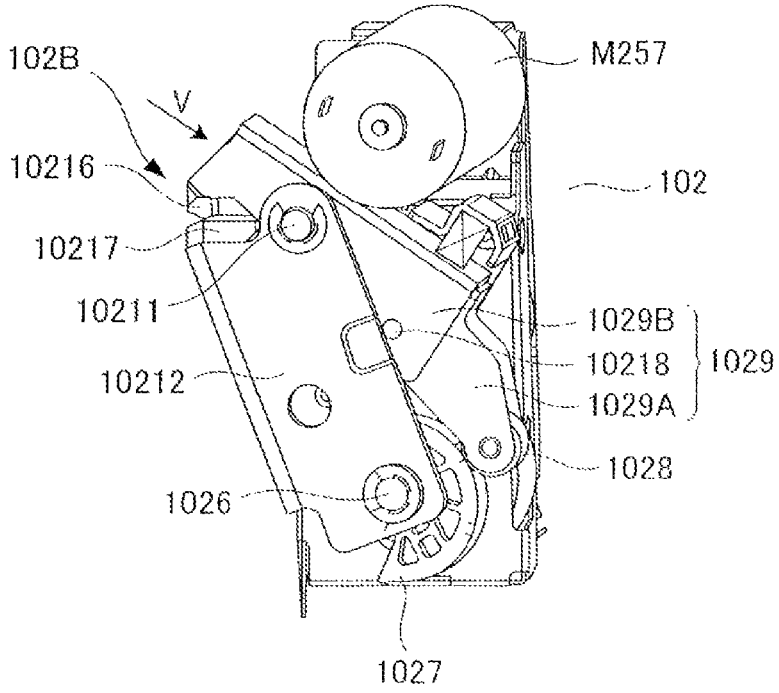
FIG. 4B is a side view illustrating the stapleless binding unit in a state where the upper arm is positioned in a binding position.
Figure 5:
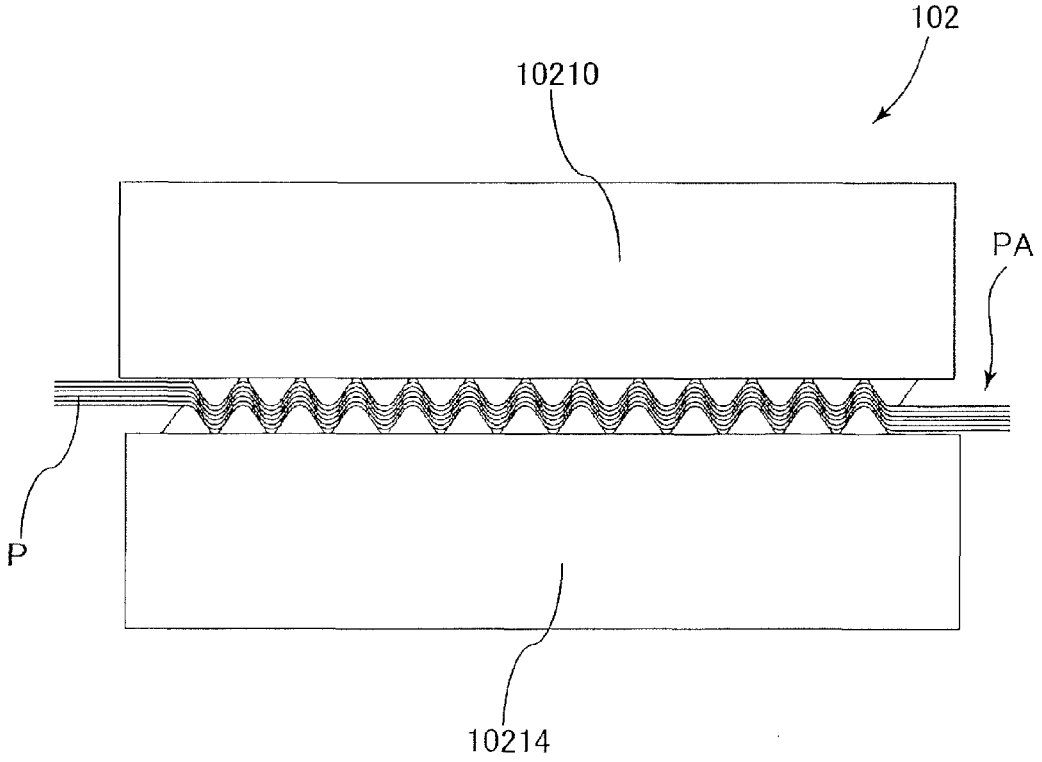
FIG. 5 is a view illustrating a state where a sheet bundle is bound by lower teeth and upper teeth provided in the stapleless binding unit.

Here, as illustrated in FIGS. 4A and 4B, upper teeth block 10216 is mounted on one end portion of a first arm 1029A described below configuring a part of the upper arm 1029 that is a second support portion. The upper teeth 10210 that are a second teeth portion is mounted on a lower surface of the upper teeth block 10216. Furthermore, a lower teeth block 10217 is mounted on one end portion of the lower arm 10212 that is the first support portion and the lower teeth 10214 that is the first teeth portion are mounted on an upper surface of the lower teeth block 10217.

In FIGS. 4A and 4B, the upper teeth 10210 and the lower teeth 10214 that is a pair of teeth portions configure a binding unit 102B engaging with and binding the plurality of sheets. It is noted that, as illustrated in FIG. 5 described below, the upper teeth 10210 and the lower teeth 10214 have teeth in which a plurality of irregularities are formed. The upper teeth 10210 and the lower teeth 10214 are configured such that the irregularities of the upper teeth 10210 and the lower teeth 10214 engage with each other.

If the upper arm 1029 is pressed up by the cam 1027, the upper arm 1029 swings around the shaft 10211 as a supporting point and an end portion of the upper arm 1029 on a side opposite to the cam 1027 is lowered. Thus, the upper teeth 10210 are lowered and, as illustrated in FIG. 5, clamp and press a sheet bundle PA together with the lower teeth 10214. Then, if pressing is performed as described above, the sheet P of the sheet bundle PA is stretched and thereby the fibers of the surface are exposed. Furthermore, the fibers between the sheets are tangled with each other by being pressed and thereby fastening of the sheet bundle PA is performed.

That is, when the binding process is performed on the sheet bundle, the upper arm 1029 is swung, the sheets are engaged with each other and pressed by the upper teeth 10210 of the upper arm 1029 and the lower teeth 10214 of the lower arm 10212, and thereby the sheet bundle is fastened. Here, a position of the cam 1027 is detected by a cam sensor S247 illustrated in FIG. 7 described below.

Figure 6:
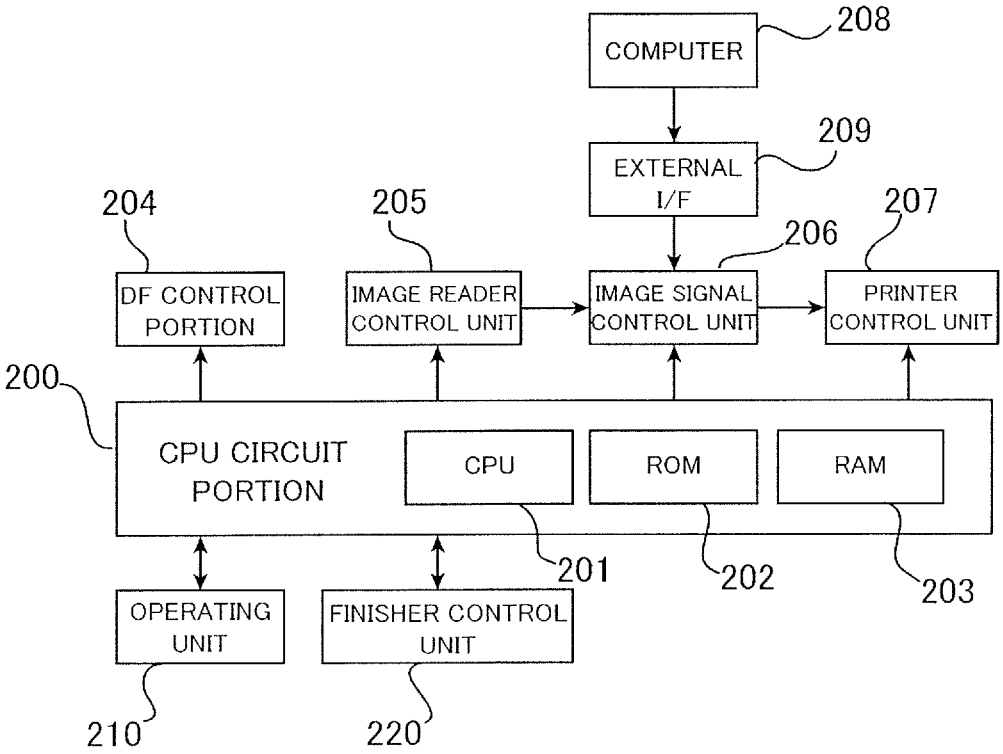
FIG. 6 is a control block diagram of the image forming apparatus.

FIG. 6 is a control block diagram of the image forming apparatus 900. In FIG. 6, the image forming apparatus 900 has the CPU circuit portion 200 that is disposed in a predetermined position of the apparatus body 900A as illustrated in FIG. 1. The CPU circuit portion 200 has a CPU 201, a ROM 202 that contains a control program and the like, and a RAM 203 that is used as a region for temporarily holding control data or a working area of calculation associated with control.

Furthermore, the CPU circuit portion 200 is connected to an image signal control unit 206 and the image signal control unit 206 is connected to an external PC (computer) 208 through an external interface 209. If print data is received from the external PC 208, the external interface 209 develops the data to a bit map image and outputs the image data to the image signal control unit 206.

Then, the image signal control unit 206 outputs the data to a printer control unit 207 and the printer control unit 207 outputs the data from the image signal control unit 206 to an exposure control portion (not illustrated). It is noted that, an image of a document read by an image sensor (not illustrated) provided in the image reading apparatus 950 is output from an image reader control unit 205 to the image signal control unit 206. The image signal control unit 206 outputs an image output to the printer control unit 207.

Furthermore, the CPU circuit portion 200 is connected to an operating unit 210 and the operating unit 210 has a plurality of keys for setting various functions regarding the image formation, a display portion for displaying a setting state, and the like. Then, the operating unit 210 outputs a key signal corresponding to an operation of each key by a user to the CPU circuit portion 200 and displays corresponding information based on a signal from the CPU circuit portion 200 to the display portion.

The CPU circuit portion 200 controls the image signal control unit 206 in accordance with the control program contained in ROM 202 and setting of the operating unit 210, and controls the original conveying unit 950A (see FIG. 1) through a DF (original conveying unit) control unit 204. Furthermore, the CPU circuit portion 200 controls respectively the image reading apparatus 950 (see FIG. 1) through the image reader control unit 205, the image forming portion 900B (see FIG. 1) through the printer control unit 207, and the finisher 100 through the finisher control unit 220.

It is noted that, in the embodiment, a finisher control unit 220 is mounted on the finisher 100 and performs drive control of the finisher 100 by exchanging information with the CPU circuit portion 200. Furthermore, the finisher control unit 220 is disposed in the apparatus body 900A integrally with the CPU circuit portion 200 and the finisher 100 may be controlled directly from the apparatus body 900A side.

Figure 7:
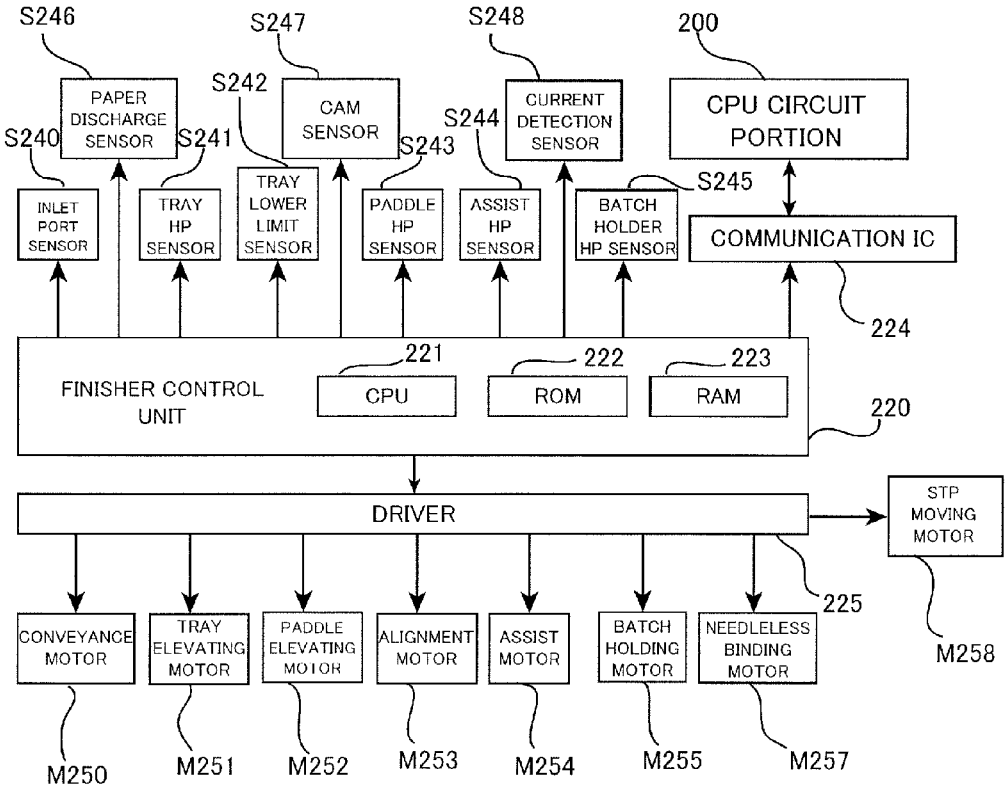
FIG. 7 is a control block diagram of the finisher.

FIG. 7 is a control block diagram of the finisher 100 according to the embodiment. The finisher control unit 220 is configured of a CPU (microcomputer) 221, a ROM 222, and a RAM 223. Then, the finisher control unit 220 performs exchange of the data by communicating with the CPU circuit portion 200 through a communication IC 224 and performs drive control of the finisher 100 by executing various programs contained in the ROM 222 based on an instruction from the CPU circuit portion 200.

Furthermore, the finisher control unit 220 drives a conveyance motor M250, a tray elevating motor M251, the paddle elevating motor M252, the alignment motor M253, the assist motor M254, the batch holding motor M255, the stapleless binding motor M257, a STP moving motor M258, and the like through a driver 225.

Furthermore, the finisher control unit 220 is connected to the inlet port sensor S240, a paper discharge sensor S246, the tray HP sensor S241, the tray lower limit sensor S242, the paddle HP sensor S243, the assist HP sensor S244, and the batch holder HP sensor S245. Furthermore, the finisher control unit 220 is connected to the cam sensor S247 and a current detection sensor S248. Then, the finisher control unit 220 drives the alignment motor M253, the stapleless binding motor M257, and the like based on the detection signal from each sensor.

However, the finisher control unit 220 controlling the operation of the stapleless binding unit 102 firstly detects a position of the cam 1027 by the cam sensor S247 if stapleless binding is performed to the sheet bundle. Then, when receiving the sheet before stapleless binding is performed, as illustrated in FIG. 4A described above, the rotation of the stapleless binding motor M257 is controlled such that the cam 1027 is positioned at a bottom dead point.

It is noted that, the upper arm 1029 provided to be swingable around the shaft 10211 is biased in a direction coming into pressure contact with the cam 1027 by a biasing member (not illustrated). Then, when the cam 1027 is positioned at the bottom dead point, as illustrated in FIG. 4A described above, a space G is provided between the upper teeth 10210 and the lower teeth 10214, and the sheet bundle is configured to be able to enter into the space G.

Furthermore, when binding operation is performed, the stapleless binding motor M257 is rotated normally and the upper arm 1029 is swung in the counterclockwise direction around the shaft 10211 by the cam 1027. Then, as illustrated in FIG. 4B described above, if the cam 1027 is positioned at a top dead point, the sheet bundle is pressed and fastened by the upper teeth 10210 of the upper arm 1029 and the lower teeth 10214 of the lower arm 10212.

It is noted that, when the stapleless binding motor M257 is rotated forward, the finisher control unit 220 detects an amount of a current flowing through the stapleless binding motor M257 based on a signal from the current detection sensor S248. The current flowing through the stapleless binding motor M257 reaches a predetermined current value when the cam 1027 is positioned at the top dead point and stapleless binding of the sheets is completed. Thus, if the current flowing through the stapleless binding motor M257 reaches the predetermined current value, the finisher control unit 220 stops driving of the stapleless binding motor M257. Furthermore, thereafter, if the stapleless binding motor M257 is rotated reversely, the cam 1027 reaches the bottom dead point, and this is detected by the cam sensor S247, the finisher control unit 220 stops the rotation of the stapleless binding motor M257.

Next, a sheet binding processing operation of the finisher 100 according to the embodiment is described. As illustrated in FIG. 2A described above, the sheet P discharged from the image forming apparatus 900 is transferred to the pair of inlet rollers 101 driven by the conveyance motor M250. At this time, a leading end of the sheet P is detected by the inlet port sensor S240.

Next, the sheet P transferred to the pair of inlet rollers 101 is transferred from the pair of inlet rollers 101 to the discharging roller pair 103, is conveyed while the leading end portion of the sheet P lifts the trailing end dropper member 105, and simultaneously is discharged to the intermediate processing tray 107 while being neutralized by the neutralization needle 104. The sheet P discharged to the intermediate processing tray 107 by the discharging rollers 103 is pressed from above by the weight of the trailing end dropper member 105 and thereby a time when the trailing end portion of the sheet P drops to the intermediate processing tray 107 is reduced.

Next, the finisher control unit 220 performs control of an inside of the intermediate processing tray 107 based on a signal of the trailing end of the sheet P detected by the paper discharge sensor S246. That is, as illustrated in FIG. 2B described above, the finisher control unit 220 lowers the take-in paddle 106 by the paddle elevating motor M252 on the intermediate processing tray 107 side and positions the take-in paddle 106 in a lowered position in which the take-in paddle 106 comes into contact with the sheet P. At this time, since the take-in paddle 106 is rotated in the counterclockwise direction by the conveyance motor M250, the sheet P is transported to the trailing end stopper 108 by the take-in paddle 106 and then the trailing end of the sheet P is transferred to the knurled belt 117. It is noted that, if the trailing end of the sheet P is transferred to the knurled belt 117, the finisher control unit 220 drives the paddle elevating motor M252 and lifts the take-in paddle 106. If it is detected that the take-in paddle 106 reaches a home position by the paddle HP sensor S243, the finisher control unit 220 stops driving of the paddle elevating motor M252.

Figure 8A:
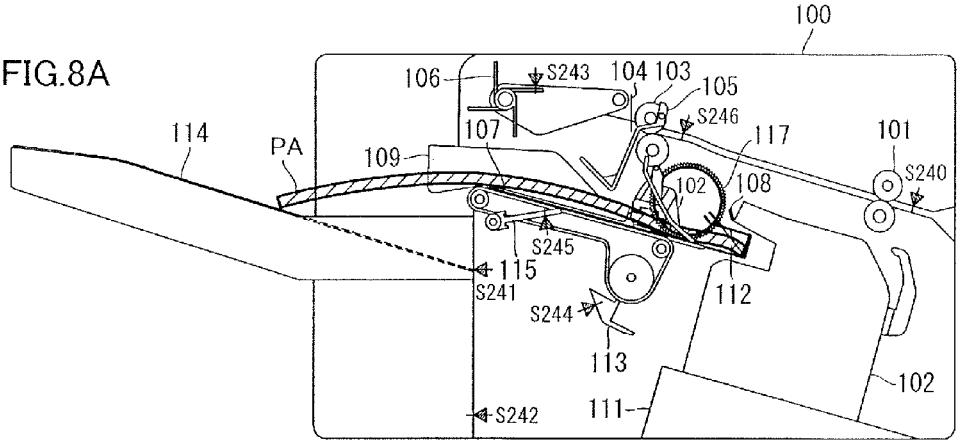
FIG. 8A is a side view illustrating a state where a sheet bundle is stacked on an intermediate processing tray.

After the sheet P transported by the take-in paddle 106 is transported to the trailing end stopper 108, the knurled belt 117 is rotated while slipping with respect to the sheet P and thereby biasing the sheet P to the trailing end stopper 108 the entire time. Thus, the sheet P abuts the trailing end stopper 108 and thereby it is possible to perform a skew correction of the sheet P. Next, as described above, after the sheet P abuts the trailing end stopper 108, the finisher control unit 220 drives the alignment motor M253, moves the aligning plate 109 in the width direction perpendicular to the sheet discharge direction, and aligns the position of the sheet P in the width direction. A series of the operation is repeatedly performed with respect to a predetermined number of the sheets to be binding-processed and thereby as illustrated in FIG. 8A, the sheet bundle PA aligned on the intermediate processing tray 107 is formed.

Figure 8B:
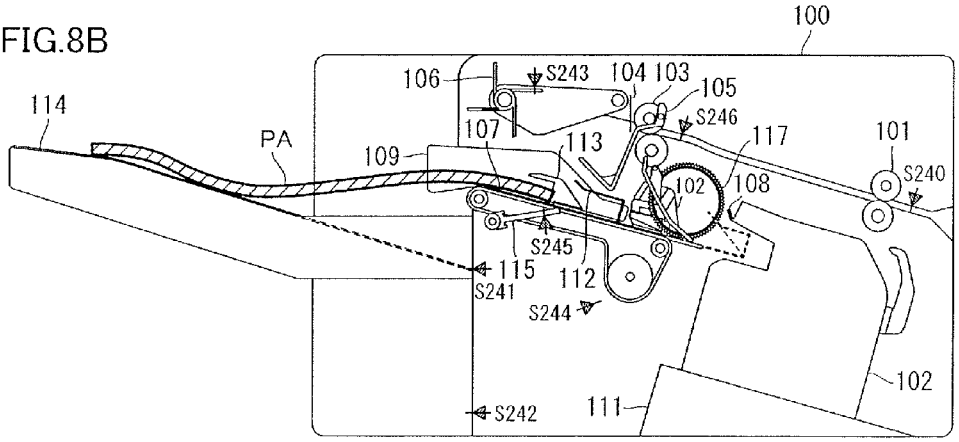
FIG. 8B is a side view illustrating a state where a trailing end assist discharges the sheet bundle stacked on the intermediate processing tray to a stacking tray.

Next, after such an aligning operation is performed, if a binding mode is selected, the binding process is performed by the binding unit 100A. Thereafter, as illustrated in FIG. 8B, the trailing end of the sheet bundle PA is pressed by the trailing end assist 112 and a discharge claw 113 driven by the assist motor M254, and the sheet bundle PA on the intermediate processing tray 107 is discharged on the stacking tray 114.

Figure 8C:
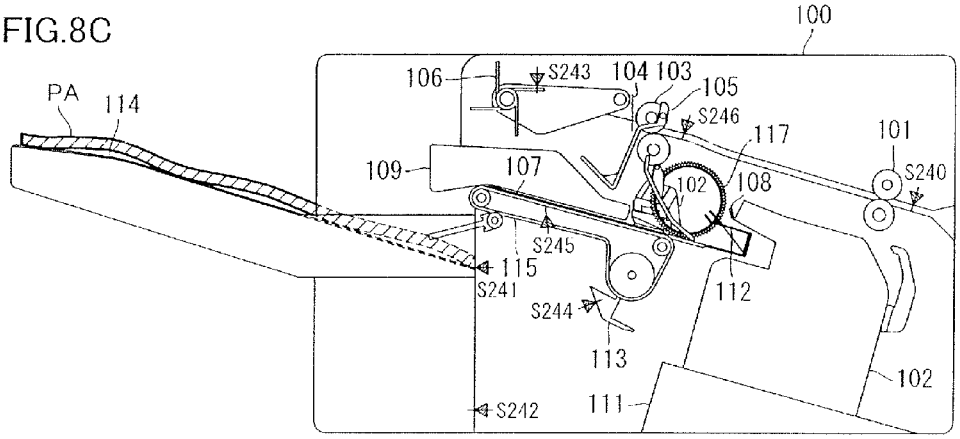
FIG. 8C is a side view illustrating a state where the sheet bundle stacked on the stacking tray is pressed by a batch holder.

It is noted that, thereafter, as illustrated in FIG. 8C, in order to prevent the sheet bundle PA antecedently stacked on the stacking tray 114 from being pressed out in the direction of conveyance by a succeeding sheet bundle, the batch holder 115 is rotated in the counterclockwise direction and then presses the trailing end portion of the sheet bundle PA. Then, after the bundle pressing operation is completed by the batch holder 115, if the sheet bundle PA shields the tray HP sensor S241 from light, the stacking tray 114 is lowered by a tray elevating motor M251 until the tray HP sensor S241 is in the transmitting state and the paper surface position is determined. It is possible to discharge a required number of sheet bundles PA on the stacking tray 114 by repeatedly performing the series of the operation described above.

It is noted that, during the operation, if the stacking tray 114 is lowered and shields the tray lower limit sensor S242 from light, a full stack of the stacking tray 114 is informed from the finisher control unit 220 to the CPU circuit portion 200 of the image forming apparatus 900 and the image formation is stopped. Thereafter, if the sheet bundle on the stacking tray 114 is removed, after the stacking tray 114 is lifted until shielding the tray HP sensor S241 from light, the stacking tray 114 is lowered and thereby the tray HP sensor S241 is transmitted through. Thus, the paper surface position of the stacking tray 114 is determined again. Thus, the image formation of the image forming apparatus 900 is restarted.

Figure 9:
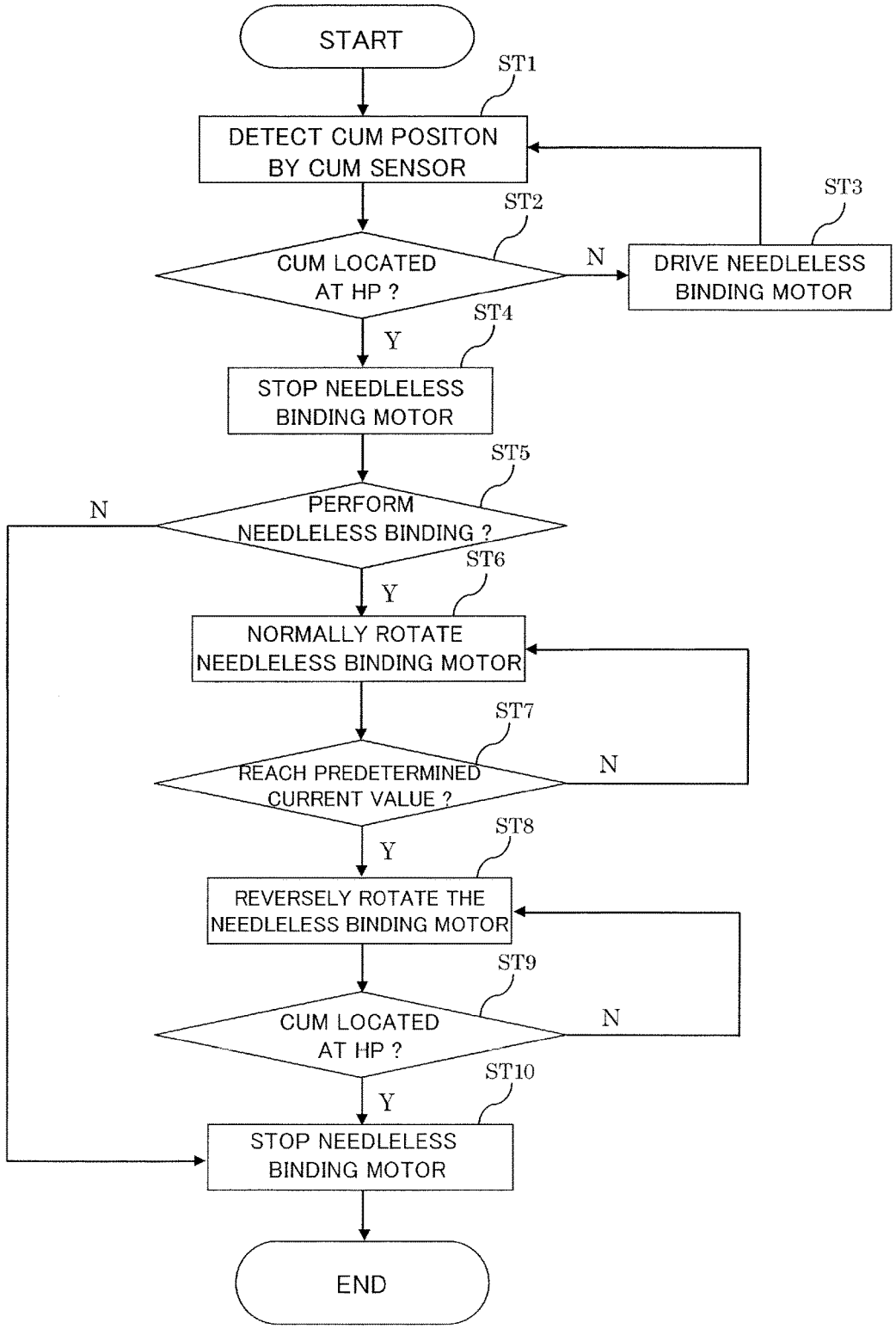
FIG. 9 is a flowchart describing control of a stapleless binding operation by a finisher control unit.

Next, when stapleless binding is performed, a stapleless binding operation control of the finisher control unit 220 is described with reference to a flowchart illustrated in FIG. 9. It is noted that, Y means YES and N means NO in FIG. 9. If stapleless binding is performed to the sheet, the finisher control unit 220 drives the stapleless binding motor M257 such that first, the cam 1027 is moved to the home position (HP) that is the position of the bottom dead point.

Then, the position of the cam 1027 is detected by the cam sensor S247 illustrated in FIG. 7 described above (ST1) and if it is determined that the cam 1027 is not present at the HP (N of ST2), the stapleless binding motor M257 is continuously driven (ST3). If it is detected that the cam 1027 is positioned at the HP by the cam sensor S247 (Y of ST2), the stapleless binding motor M257 is stopped (ST4). Thus, as illustrated in FIG. 4A described above, the space G is generated between the upper teeth 10210 and the lower teeth 10214 and the sheet receiving state before stapleless binding is performed is completed.

Next, the finisher control unit 220 determines whether or not to perform the stapleless binding operation (ST5). If stapleless binding is performed (Y of ST5), the finisher control unit 220 normally rotates the stapleless binding motor M257 (ST6) and swings the upper arm 1029 around the shaft 10211 by the cam 1027 in the counterclockwise direction. Thereafter, if the cam 1027 is further rotated and reaches the position indicated in FIG. 4B, the sheet bundle is clamped by the upper teeth 10210 of the upper arm 1029 and the lower teeth 10214 of the lower arm 10212, and the sheet bundle is fastened.

Here, the finisher control unit 220 determines whether the current flowing through the stapleless binding motor M257 reaches a predetermined current value based on a signal from the current detection sensor S248 (ST7). Then, if it is detected that the current reaches the predetermined current value (Y of ST7), the stapleless binding motor M257 is rotated reversely (ST8). Thus, the cam 1027 is rotated reversely. Therefore, the upper arm 1029 swings around the shaft 10211 in a clockwise direction and the upper teeth 10210 move in a direction separated from the lower teeth 10214.

Next, the finisher control unit 220 determines whether the cam 1027 reaches the HP by the cam sensor S247 (ST9). Then, if it is determined that the cam 1027 does not reach the HP (N of ST9), the stapleless binding motor M257 is continuously rotated reversely (ST8). Thereafter, if it is detected that the cam 1027 is positioned at the HP by the cam sensor S247 (Y of ST9), the stapleless binding motor M257 is stopped (ST10). Thus, the binding operation of the sheet bundle is completed. Furthermore, if the binding operation is not performed, the process proceeds from ST5 to ST10, and the stapleless binding motor M257 continues a stop state.

Figure 10A:
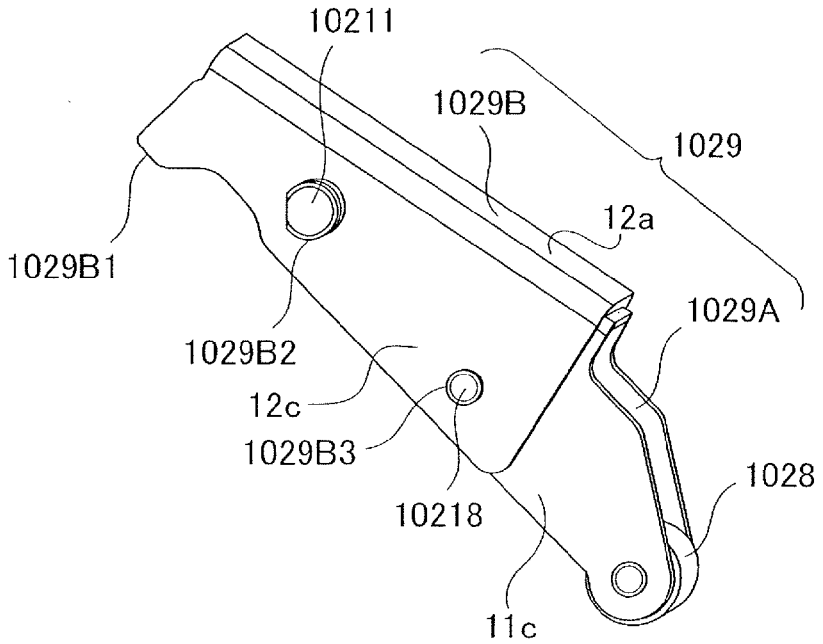
FIG. 10A is a perspective view illustrating the upper arm of the stapleless binding unit.

As illustrated in FIG. 10A, the upper arm 1029 is configured of the first arm 1029A that is a U-shaped plate member and a second arm 1029B that is a U-shaped plate member mounted to cover a part of the first arm 1029A from above. Furthermore, the second arm 1029B is disposed to overlap the first arm 1029A. That is, in the embodiment, the upper arm 1029 is formed of a double structure configured of the first arm 1029A and the second arm 1029B which are the plate members of which both end portions are bent. Thus, the upper arm 1029 obtains predetermined load-bearing.

Figure 13:
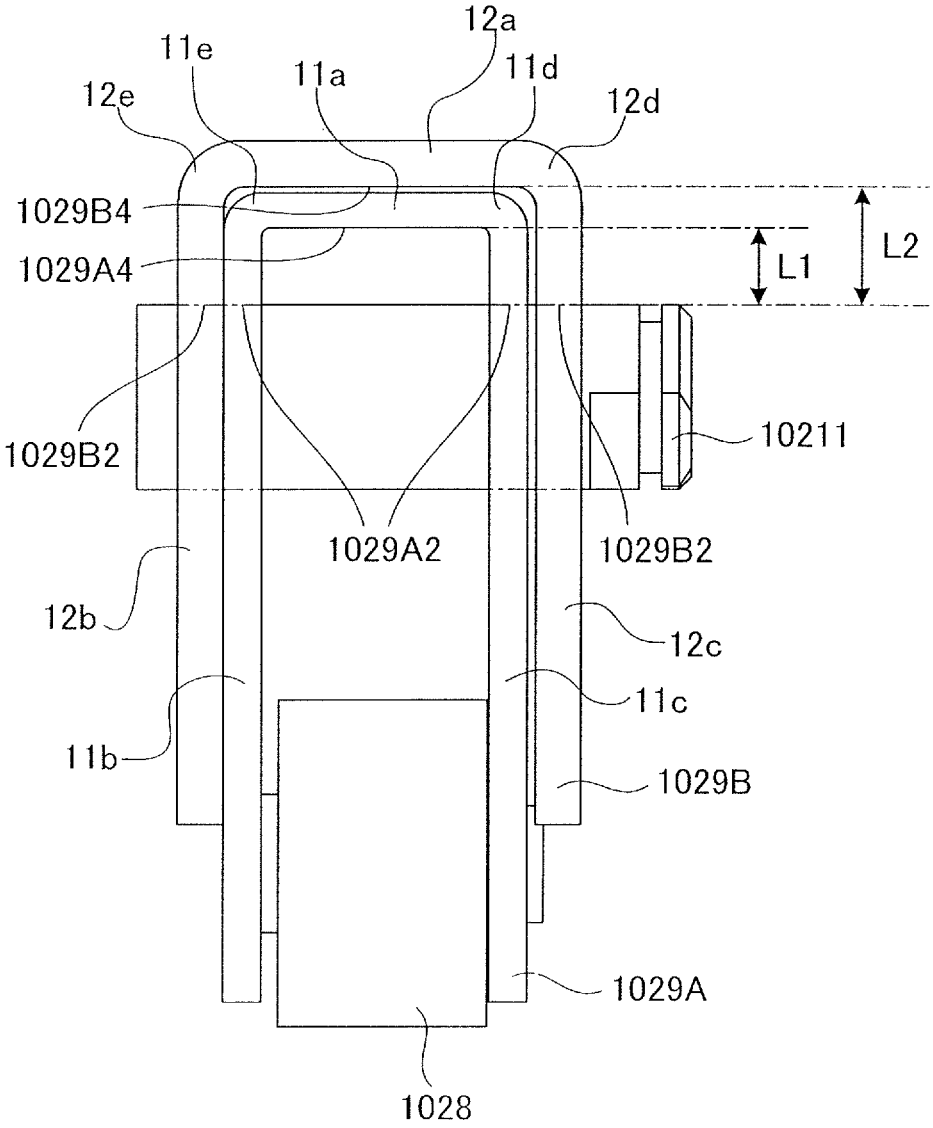
FIG. 13 is a view of the first arm and the second arm viewed in an arrow direction V of FIG. 4B.

As illustrated in FIGS. 10A and 13, the second arm 1029B has a top plate portion 12*a* (second top plate portion) and side surface portions 12*b* and 12*c* (second side surface portions) that are bent from both end portions of the top plate portion 12*a* and extends in the same direction, and configures entirely U shape. Furthermore, the second arm 1029B has bending portions 12*d* and 12*e* (second bending portions) that are formed between the top plate portion 12*a* and the side surface portions 12*b* and 12*c* in a circle arc shape. The side surface portions 12*b* and 12*c* are respectively provided with through-holes 1029B2 and 1029B2 (second through-holes) through which the shaft 10211 passes.

Figure 10B:
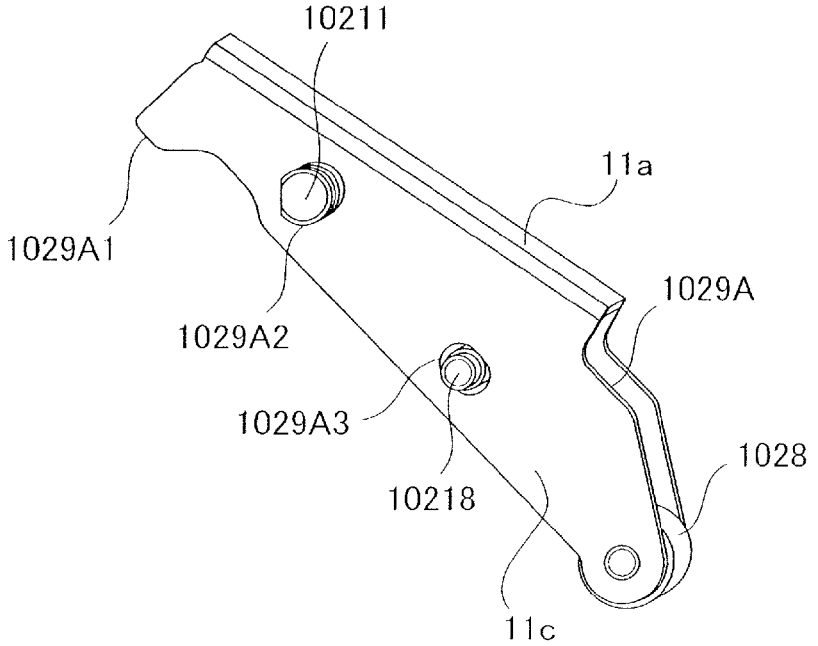
FIG. 10B is a perspective view illustrating a first arm configuring a part of the upper arm.

As illustrated in FIGS. 10B and 13, the first arm 1029A has a top plate portion 11*a* (first top plate portion) and side surface portions 11*b* and 11*c* (first side surface portions) that are bent from both end portions of the top plate portion 11*a* and extend in the same direction, and configures a U shape entirely. Furthermore, the first arm 1029A has bending portions 11*d* and 11*e* (first bending portions) that are formed between the top plate portion 11*a* and the side surface portions 11*b* and 11*c* in a circle arc shape. Through-holes 1029A2 and 1029A2 (first through-holes) through which the shaft 10211 passes are formed in the side surface portions 11*b* and 11*c*. Thus, the first arm 1029A and the second arm 1029B are provided to be swingable around the shaft 10211.

Furthermore, the side surface portions 11*b* and 11*c* of the first arm 1029A that is the first arm member are respectively provided with long round holes 1029A3 and 1029A3 through which a fixing shaft 10218 passes. Similarly, the side surface portions 12*b* and 12*c* of the second arm 1029B that is the second arm member are respectively provided with through-holes 1029B3 and 1029B3 through which the fixing shaft 10218 passes. The fixing shaft 10218 passes through the long round hole 1029A3 and the through-hole 1029B3, and one end of the fixing shaft 10218 is caulked into the through-hole 1029B3 of the second arm 1029B. Then, the first arm 1029A and the second arm 1029B are connected by the shaft 10211 and the fixing shaft 10218, and are relatively positioned.

Figure 11:
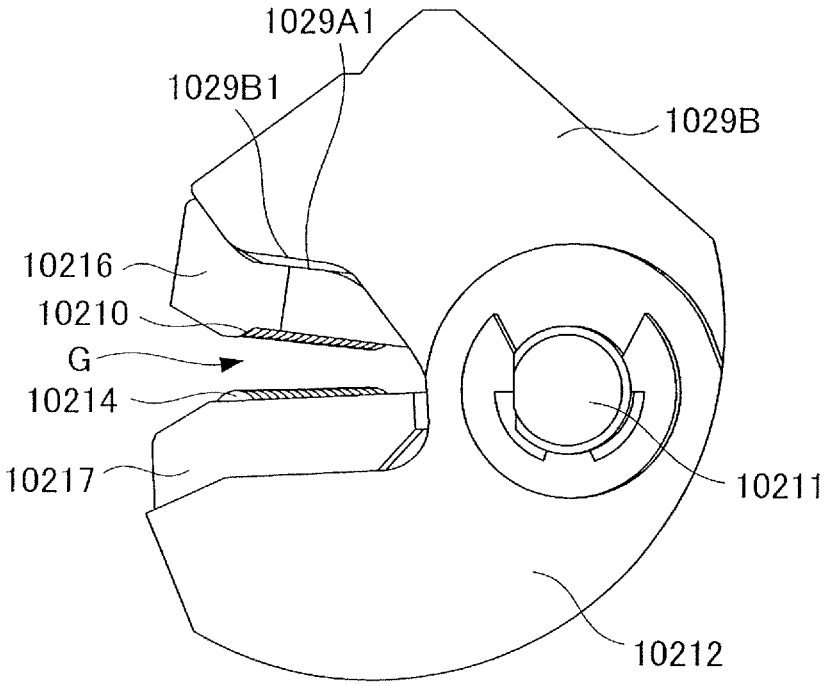
FIG. 11 is an enlarged side view describing amounting positional relationship of the first arm and a second arm configuring the upper arm.
Figure 12:
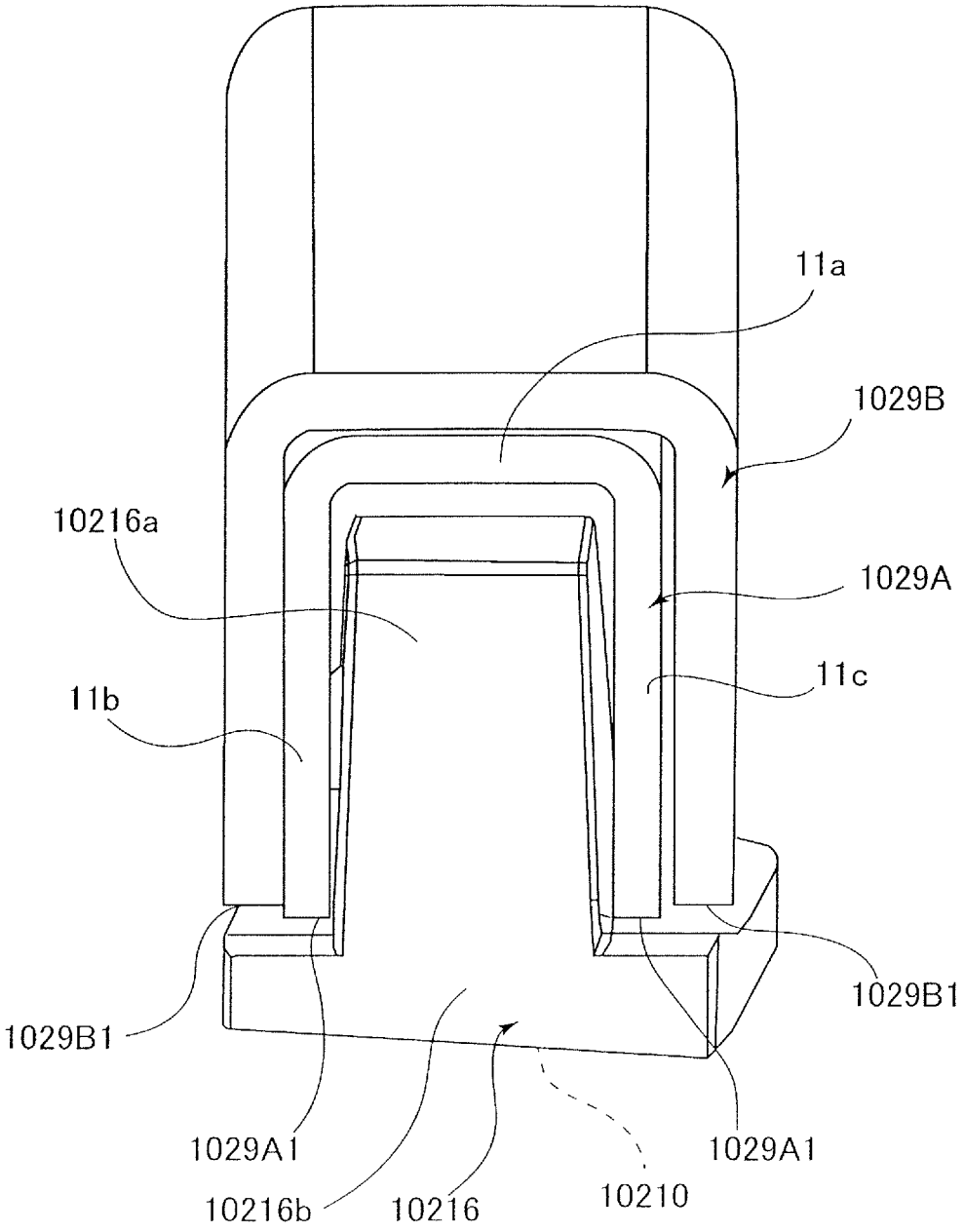
FIG. 12 is a front view illustrating the arrangements of the first arm, the second arm, and an upper teeth block.

As shown in FIGS. 11 and 12, the upper teeth block portion 10216 includes the block portion 10216*a* stored within the first arm 1029A and the extension portion 10216*b* provided under the block portion 10216*a* and extends in a horizontal direction. The upper teeth 10210 are formed on an under surface of the extension portion 10216*b*. The extension portion 10216*b* of the upper teeth block portion 10216 is attached to the support end 1029A1, i.e., one end of the first arm 1029A.

The support end 1029A1 of the first arm 1029A projects downward more than the support end 1029B1 of the second arm 1029B, and the support end 1029B1 is distant from the upper teeth block portion 10216. Thereby, while the upper teeth 10210 is supported by the first arm 1029A through the upper teeth block portion 10216, it is not supported by the second arm 1029B in a state when no pressure is applied. It is noted that in the state when no pressure is applied, the extension portion 10216*b* overlaps horizontally with the support end 1029A1 of the first arm 1029A and with the support end 1029B1 of the second arm 1029B.

Meanwhile, as shown in FIG. 4B described above, in a pressure state in which the upper teeth 10210 presses the sheet bundle together with the lower teeth 10214, the first arm 1029A deflects upward and the extension portion 10216*b* of the upper teeth block portion 10216 abuts against the support end 1029B1 of the second arm 1029B. That is, in performing the stapleless binding process, the second arm 1029B abuts against the upper teeth block portion 10216, and the second arm 1029B also supports the upper teeth 10210 together with the first arm 1029A. Accordingly, when the upper arm 1029 is located at the binding position, a load received by the upper arm 1029 from the lower teeth 10214 through the sheet bundle is dispersed to the first and second arms 1029A and 1029B. It is noted that the first and second arms 1029A and 1029B, constituting the upper arm 1029, shall locate at the binding position or the release position in a state where the upper arm 1029 is located at the binding position or the release position.

It is noted that, the upper teeth block 10216 is mounted on the first arm 1029A and the support end 1029A1 of the first arm 1029A is protruded downward more than the support end 1029B1 of the second arm 1029B. This is because of a consideration of processing variation by pressing. If processing variation is considered, it is difficult to make the support end 1029A1 of the first arm 1029A and the support end 1029B1 of the second arm 1029B in the equal plane at all times. However, the support end 1029A1 of the first arm 1029A and the support end 1029B1 of the second arm 1029B may be provided in the equal plane.

Here, in the embodiment, as described below, since the plate thickness of the first arm 1029A is thinner than the plate thickness of the second arm 1029B, the first arm 1029A is likely to be deflected more than the second arm 1029B. Thus, when performing stapleless binding, the first arm 1029A on which the upper teeth block 10216 is mounted is protruded upward and is deflected, and thereby it is possible to stably support the upper teeth block 10216 (upper teeth 10210) by the first arm 1029A and the second arm 1029B in the pressed state described above. That is, when the upper arm 1029 is positioned in the binding position, the second arm 1029B regulates deflection of the first arm 1029A.

It is noted that, in the embodiment, in the state of FIG. 11, the support end 1029A1 of the first arm 1029A that is the first support surface that supports the upper teeth block 10216 is protruded downward more than the support end 1029B1 of the second arm 1029B that is the second support surface by approximately 0.2 mm. Thus, even if processing variation is generated by pressing, it is possible to reliably support the upper teeth block 10216 (upper teeth 10210) by the first arm 1029A and the second arm 1029B in the pressed state.

FIG. 13 is a view of the first arm 1029A and the second arm 1029B viewed from arrow direction V indicated in FIG. 4B described above. In FIG. 13, a distance L1 indicates a distance from a lower surface 1029A4 of the top plate portion 11*a* in the first arm 1029A to the through-holes 1029A2. A distance L2 indicates a distance from a lower surface 1029B4 of the top plate portion 12*a* in the second arm 1029B to the through-holes 1029B2. It is noted that, a lower surface of the top plate portion 11*a* of the first arm 1029A is a surface on a side opposite to a surface of the top surface 11*a* facing the top plate portion 12*a*. A lower surface of the top plate portion 12*a* of the second arm 1029B is a surface on a side opposite to a surface of the top plate portion 12*a* facing the top plate portion 11*a*.

If the distances L1 and L2 are short, the through-holes 1029A2 and 1029B2 may be deformed when performing bending after hole making. Here, when the plate thickness of the first arm 1029A and the second arm 1029B is t and a radius of the inner side surface of the bending portion is R, if L1, L2≥2t+R, it is possible to prevent deformation of the through-holes 1029A2 and 1029B2 even if bending is performed after hole making.

It is noted that, in the embodiment, the plate thickness t of the first arm 1029A is 1.5 mm and an inner radius R of bending is 0.75 mm. Since it is necessary to set the inner radius R of bending ½ or more of the plate thickness t to ensure durability of the mold in pressing, the inner radius R is 0.75 mm that is ½ of the plate thickness t. As a result, in order to prevent the deformation of the through-hole 1029A2, a length of the distance L1 is 3.75 mm (=1.5 mm×2+0.75 mm) considering the plate thickness t and the inner radius R of bending.

Furthermore, the plate thickness of the second arm 1029B is 2.0 mm. Furthermore, since it is necessary to set the inner radius R of bending ½ or more of the plate thickness t to ensure durability of the mold in pressing, the inner radius R is 1.0 mm that is ½ of the plate thickness t. As a result, in order to prevent the deformation of the through-hole 1029B2, the length of the distance L2 is 5.5 mm that is greater than 5.0 mm (=2.0 mm×2+1.0 mm) considering the plate thickness t and the inner radius R of bending. That is, the length of the distance L2 is set to be smaller than three times (2.0 mm×3=6.0 mm) the plate thickness t of the second arm 1029B.

Here, if the upper arm 1029 is not the double structure of the first arm 1029A and the second arm 1029B, and the plate thickness t of one structure is 3.5 mm, it is necessary to make the inner radius R of bending 1.75 mm. In this case, in order to prevent the deformation of the through-hole, a distance from the top plate portion to the through-hole is 8.75 mm (=3.5 mm×2+1.75 mm).

It is noted that, since load-bearing is increased by increasing the plate thickness t, if the plate thickness t is decreased to 3.0 mm in accordance with a desired load-bearing when binding by clamping the sheet bundle, the inner radius R becomes 1.5 mm. In this case, the distance from the top plate portion to the through-hole becomes 7.5 mm (=3.0 mm×2+1.5). As described above, the distance from the top plate portion to the through-hole is shorter in the value (=5.5 mm) of the distance L2 indicating the distance when the upper arm 1029 is the double structure than the distance (=7.5 mm) when the upper arm 1029 is single structure. Thus, it is possible to reduce the external shape of the upper arm 1029. That is, if load-bearing is equal, it is possible to reduce the external shape of the upper arm 1029 in the double structure more than the single structure.

As described above, in the embodiment, the upper arm 1029 is configured of the U-shaped first arm 1029A and the second arm 1029B mounted to cover a part of the first arm 1029A. Then, if the upper arm 1029 is configured of the first arm 1029A and the second arm 1029B, even if the plate thicknesses of the first arm 1029A and the second arm 1029B are respectively thin, it is possible to obtain desired load-bearing by receiving the load by the first arm 1029A and the second arm 1029B.

Furthermore, the plate thicknesses of the first arm 1029A and the second arm 1029B are thinner than that of the single structure that is configured to have load-bearing equal to the upper arm 1029 configured of the double structure. Thus, it is possible to reduce the distance from the through-holes 1029A2 and 1029B2 to the top plate portion of the upper arm 1029, and to downsize the upper arm 1029. That is, the upper arm 1029 is configured of the first arm 1029A and the second arm 1029B, and the plate thicknesses of the first arm 1029A and the second arm 1029B are thin, and thereby it is possible to downsize the upper arm 1029 at low cost.

It is noted that, in the above description, the upper arm 1029 has the double structure, the number of overlapping U-shaped arms is not limited to the embodiment and it is possible to obtain the same effects also in a triple structure or more.

Furthermore, in the embodiment, since the U shape of the lower arm 10212 is larger than the U shape of the upper arm

1029, load-bearing is also large by setting the plate thickness of the lower arm 10212 thicker than that of the second arm 1029B. Thus, the lower arm 10212 can ensure the strength without being made by the double structure, but the lower arm 10212 may have the double structure. That is, in the above description, a case where the upper arm 1029 has the double structure is described, but if at least one of the upper arm 1029 and the lower arm 10212 has the double structure, it is possible to downsize the arm having the double structure.

Furthermore, in the embodiment, the lower arm 10212 is fixed and the upper arm 1029 is capable of swing, but the configuration is not limited to the embodiment. For example, the upper arm 1029 is fixed, and the lower arm 10212 may be capable of swing, and may have the double structure. For example, both the upper arm 1029 and the lower arm 10212 may be capable of swing and may have the double structure.

Furthermore, in the embodiment, in a state where the upper arm 1029 is positioned in the binding position, the upper teeth block 10216 mounted on the first arm 1029A is configured to abut the second arm 1029B, but the configuration is not limited to the embodiment. For example, the first arm 1029A receiving the load from the upper teeth block 10216 is deformed, the deformed first arm 1029A is configured to abut the second arm 1029B, and the second arm 1029B may be configured to receive the load of the upper teeth block 10216 through the first arm 1029A.

Furthermore, the second arm 1029B may be welded to the first arm 1029A. Furthermore, the upper teeth block 10216 and the first arm 1029A may be integrally formed.

Furthermore, in the embodiment, the upper teeth block 10216 is mounted on the first arm 1029A, but the upper teeth block 10216 is mounted on the second arm 1029B, and the first arm 1029A may receive the loads of the second arm 1029B and the upper teeth block 10216.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-137418, filed Jul. 3, 2014, and Japanese Patent Application No. 2015-126586, filed Jun. 24, 2015, which are hereby incorporated by reference herein in its entirety.

What is claimed is:

1. A sheet processing device comprising:

a first teeth portion;

a second teeth portion configured to clamp and bind a sheet bundle with the first teeth portion;

a first support portion configured to support the first teeth portion;

a shaft; and a second support portion configured to support the second teeth portion and being swingably supported around the shaft between a binding position in which the second teeth portion clamps and binds the sheet bundle with the first teeth portion and a standby position in which the second teeth portion is apart from the first teeth portion, the second support portion including:

a first arm member including a first portion and a pair of first side portions provided on both ends of the first portion, each of the pair of first side portions extending perpendicular to the first portion and defining a first through-hole in which the shaft is inserted; and a second arm member including a second portion and a pair of second side portions provided on both ends of the second portion, each of the pair of second side portions extending perpendicular to the second portion and defining a second through-hole in which the shaft is inserted, the second arm member being fixed to the first arm member.

2. The sheet processing device according to claim 1, wherein the second support portion receives a load applied to the second teeth portion dispersedly by the first and second arm members in a state where the second support portion is positioned in the binding position.

3. The sheet processing device according to claim 2, wherein the second arm member regulates deflection of the first arm member in a state where the second support portion is positioned in the binding position.

4. The sheet processing device according to claim 3, wherein the second teeth portion is provided on the first arm member, and wherein the second arm member is disposed apart from the second teeth portion in a state where the second support portion is positioned in the standby position, and contacts with the second teeth portion by the first arm member deflecting in a direction separated from the first teeth portion in a state where the second support portion is positioned in the binding position.

5. The sheet processing device according to claim 1, wherein the first and second arm members are plate members and a plate thickness of the first arm member is less than a plate thickness of the second arm member.

6. The sheet processing device according to claim 1, wherein the first arm member is a plate member of a U-shaped cross section and bent between the first portion and the first side portions, and wherein the second arm member is a plate member of a U-shaped cross section and bent between the second portion and the second side portions.

7. The sheet processing device according to claim 6, wherein the second teeth portion is provided on the first arm member and a plate thickness of the first arm member is thinner than a plate thickness of the second arm member.

8. The sheet processing device according to claim 6, wherein the first arm member includes first bending portions formed in a circular arc shape between the first portion and each of the first side portions, and wherein a distance between a surface, on a side opposite to a surface facing the second portion, of the first portion and each first through-hole is set to a sum of twice the plate thickness of the first arm member and a radius of an inner surface of one of the first bending portions.

9. The sheet processing device according to claim 8, wherein a radius of the inner side surface of one of the first bending portions is set to a half of the plate thickness of the first arm member.

10. The sheet processing device according to claim 6, wherein the second arm member includes second bending portions formed in a circular arc shape between the second portion and each of the second side portions, and wherein a distance between a surface, on a side opposite to a surface facing the first portion, of the second portion and each second through-hole is set to be greater than a sum of twice the plate thickness of the second arm member and a radius of an inner surface of one of the second bending portions, and less than three times the plate thickness of the second arm member.

11. The sheet processing device according to claim 10, wherein the radius of the inner side surface of one of the second bending portions is set to a half of the plate thickness of the second arm member.

12. The sheet processing device according to claim 1, wherein the first support portion is a plate member of which an external dimension is greater than that of the second arm member, and wherein a plate thickness of the first support portion is thicker than a plate thickness of the second arm member.

13. The sheet processing device according to claim 1, further comprising:

a cam that presses an end of the second support portion and swings the second support portion around the shaft.

14. The sheet processing device according to claim 13, wherein the second support portion includes a fixing portion that is disposed between the shaft and the end of the second support portion, and connects the first arm member and the second arm member.

15. The sheet processing device according to claim 13, wherein the second teeth portion is disposed on an end of the first arm member, positioned opposite to the end of the second support portion across the shaft.

16. An image forming apparatus comprising:

an image forming portion that forms an image on a sheet; and the sheet processing device according to claim 1 that binds the sheet on which the image is formed by the image forming portion.

17. The sheet processing device according to claim 1, wherein the second teeth portion is disposed so as to overlap with the pair of first side portions of the first arm member and the pair of second side portions of the second arm member in an axial direction of the shaft.

18. The sheet processing device according to claim 17, wherein the second teeth portion comprises a block portion disposed between the pair of first side portions of the first arm member, an extension portion, and a teeth part provided on the extension portion and configured to clamp and bind the sheet bundle, and wherein the extension portion is integrally provided on the block portion, extends in the axial direction of the shaft, and is configured to contact the first and second arm members.

19. A sheet processing device comprising:

a first teeth portion;

a second teeth portion configured to clamp and bind a sheet bundle with the first teeth portion;

a first support portion configured to support the first teeth portion;

a shaft; and a second support portion configured to support the second teeth portion and being swingably supported around the shaft between a binding position in which the second teeth portion clamps and binds the sheet bundle with the first teeth portion and a standby position in which the second teeth portion is apart from the first teeth portion, the second support portion including:

a first arm member; and a second arm member fixed to the first arm member, wherein the second teeth portion is provided on one of the first and second arm members, and wherein the other of the first and second arm members is disposed apart from the second teeth portion in a state where the second support portion is positioned in the standby position, and contacts with the second teeth portion by one of the first and second arm members deflecting in a direction separated from the first teeth portion in a state where the second support portion is positioned in the binding position.

* * * * *